US006070302A

United States Patent [19]

Graf

[11] Patent Number: 6,070,302

[45] Date of Patent: Jun. 6, 2000

[54] CARD CLOTHING FOR CARDS AND/OR CARDING MACHINES

[75] Inventor: Ralph A. Graf, Freienbach, Switzerland

[73] Assignee: Graf + Cie AG, Rapperswil, Switzerland

[21] Appl. No.: 09/330,734

[22] Filed: Jun. 11, 1999

[30] Foreign Application Priority Data

May 15, 1998 [DE] Germany ..... 198 26 542

[51] Int. Cl.[7] ..... D01G 15/84

[52] U.S. Cl. ..... 19/114; 19/98

[58] Field of Search ..... 19/98, 102, 104, 19/110, 111, 113, 114; 492/30, 50, 56

[56] References Cited

U.S. PATENT DOCUMENTS

| | | | |
|---|---|---|---|
| 213,876 | 4/1879 | Cunningham | 19/114 |
| 578,592 | 3/1897 | Ashworth | 19/114 |
| 1,293,504 | 2/1919 | Midgley | 19/114 |
| 2,190,631 | 2/1940 | Bass | 19/114 |
| 2,268,459 | 12/1941 | Murray | 19/114 |
| 2,488,442 | 11/1949 | Snape, Jr. | 19/114 |
| 2,848,755 | 8/1958 | Caille | 19/114 |
| 3,058,168 | 10/1962 | LaRoche | 19/114 |
| 3,290,729 | 12/1966 | Maynard | 19/114 |
| 3,947,922 | 4/1976 | Ibbotson | 19/114 |
| 4,356,598 | 11/1982 | Graf | 19/114 |

FOREIGN PATENT DOCUMENTS

| | | |
|---|---|---|
| 648230 | 7/1937 | Germany . |
| 8803283 | 6/1988 | Germany . |

*Primary Examiner*—Michael A. Neas
*Assistant Examiner*—Gary L. Welch
*Attorney, Agent, or Firm*—Friedrich Kueffner

[57] ABSTRACT

A card clothing for cards and/or carding machines includes several coating material layers which are composed of cotton and are connected through a binding agent with each other and with an elastomer cover layer provided on one of the outer sides to form a coating material unit. The coating material layers are equipped with hooks which extend transversely of the coating material layers and extend through the coating layers in the direction toward the elastomer cover layer and protrude with their tips. For reducing the harmful influences on the carding process resulting from electrostatic charges of the coating material unit due to accumulations of fibers and/or dust in the clothing area, inhibitors which at least reduce the generation of the electrostatic charges are added in the clothing area. Embedded at least in the cover layer is an electrically conductive material which serves for discharging the frictional electricity.

12 Claims, 1 Drawing Sheet

CARD CLOTHING FOR CARDS AND/OR CARDING MACHINES

BACKGROUND OF THE INVENTION

1. Field of the Invention

The present invention relates to a card clothing for cards and/or carding machines, the card clothing having the form of several coating material layers which are preferably composed of cotton and are connected through a binding agent with each other and with an elastomer cover layer provided on one of the outer sides to form a coating material unit and which are equipped with hooks, preferably double hooks, which extend transversely of the coating material layers and which extend through the coating layers in the direction toward the elastomer cover layer and protrude with their tips, wherein further, preferably for reducing the harmful influences on the carding process resulting from electrostatic charges of the coating material unit due to accumulations of fibers and/or dust in the clothing area, inhibitors which at least reduce the generation of the causal electrostatic charges are added in the clothing area.

2. Description of the Related Art

Concerning the construction of the above-mentioned card clothes and the use of suitable fabrics, reference is being made to the relevant technical literature, namely, British Patent 6584 (1834), and also "Handbuch der Baumwollspinnerei" [Manual of cotton spinning], volume 1, Leipzig 1902, page 397 ff., and volume 3, Leipzig 1948, page 253 ff. and page 478 ff.

The above-mentioned problem of static charging during the carding process, i.e., the electrostatic charging of the textile staple fibers to be carded with the negative effect on the ejection of these fibers has been known for several decades.

For eliminating short fibers or dust particles which adhere to the elastomer cover layer or the coating material surface of card clothing or card fillet clothing and lead to quality reductions, the cards or carding machines are conventionally kept clean by means of suction devices which are integrated in today's modern high-capacity machines. However, in spite of their relatively high energy consumption, they are not capable of completely eliminating and discharging the short fibers and dust particles which adhere due to the electrostatic charging. Rather, in the desire to optimize the removal by increasing the suction power, it has been found that parts of the fiber material to be processed are also grasped and discharged in a disadvantageous manner.

In order to reduce this charging and, thus, the negative effects, it has already been proposed to arrange underneath the licker-in grate of a card and/or carding machine a so-called static plate of a type of plush, then a ribbed brass sheet and finally a special synthetic resin substance. Also known is the use of an electrically conductive clothing which is capable of discharging the charge and, thus, of reducing the adherence of the fibers to the clothing, so that a better removal or discharge of undesired short fibers is achieved. For this purpose, as proposed in "Klepzigs Textil-Zeitschrift" 1938, Volume 45, an electrically conductive coating material in the form of a multiple material layer unit with rubber covered plate is to be used in which a temporary reduction of the static charging could be achieved as a result of chemicals added to the natural rubber. The effect of the electrostatic inhibitors was also further reduced by the evaporation of the solvents of the natural rubber, such as toluene, heptane or industrial gasoline, even though the rubber cover plate and the adhesives of the card cloth are completely acid-free.

SUMMARY OF THE INVENTION

Starting from this state of the art and the experiences had in using the known clothing materials, it is the object of the invention to further develop the card clothing of the above-described type in a simple and effective manner in such a way that a significant and practically uniform reduction of the static charging is achieved over the service life of the card clothing elements, such as the cover clothing, cleaning cards or the like.

In accordance with the present invention, at least in the cover layer of the card clothing is embedded an electrically conductive material which serves for discharging the frictional electricity.

A card clothing constructed in this manner ensures that, even without expensive suction devices with high energy consumption, a sufficient removal of short fibers and dust particles which negatively influence the quality is ensured because electrostatic charging practically does not occur.

The various features of novelty which characterize the invention are pointed out with particularity in the claims annexed to and forming a part of the disclosure. For a better understanding of the invention, its operating advantages, specific objects attained by its use, reference should be had to the drawing and the descriptive matter in which there are shown and described preferred embodiments of the invention.

DESCRIPTION OF THE PREFERRED EMBODIMENTS

Figure 1:
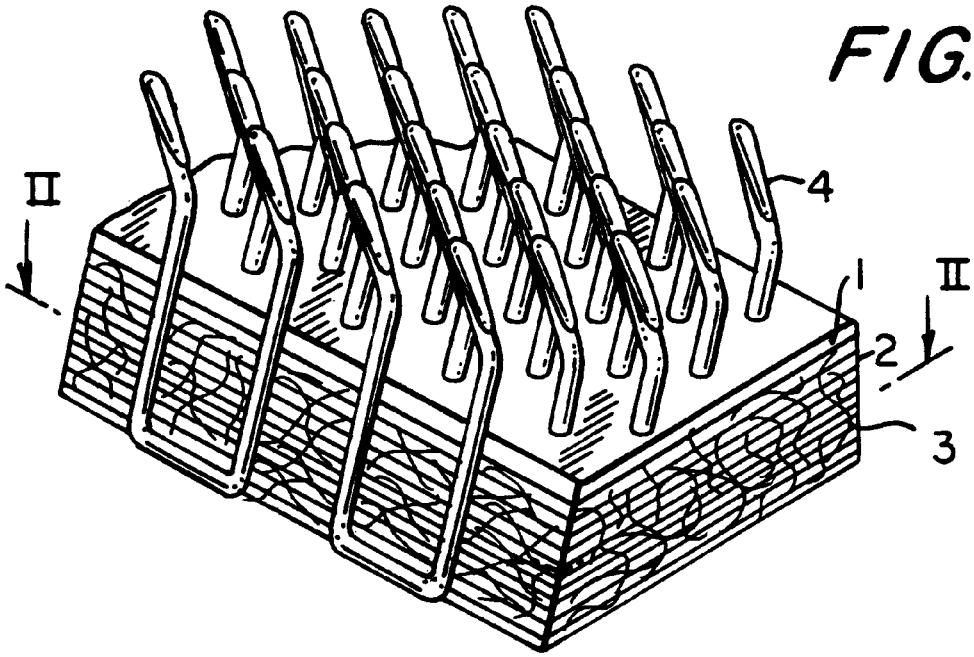
FIG. 1 is a partial sectional view of a card clothing in accordance with the present invention.

As illustrated in FIG. 1 of the drawing, the card clothing according to the present invention is composed of a plurality of coating material layers 2 and an elastomer cover layer 1. A plurality of double hooks 4 extend transversely of the coating material layers 2 and protrude with their tips above the elastomer cover layer 1.

Figure 2:
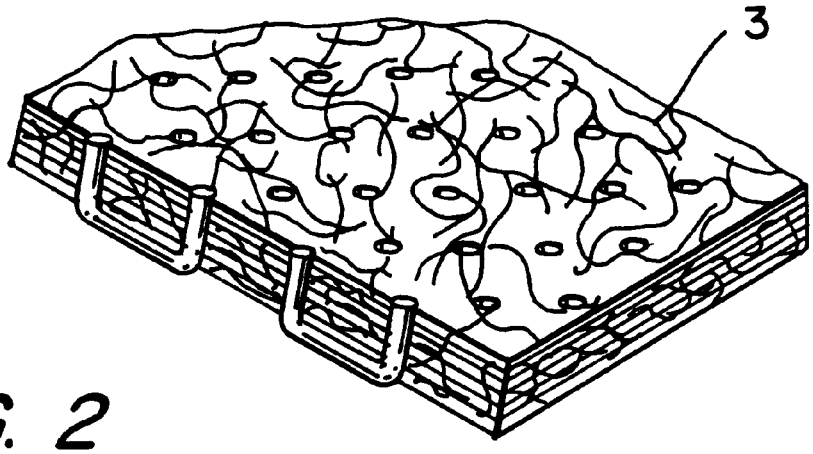
FIG. 2 is a sectional view taken along sectional line II—II of FIG. 1.

In accordance with the present invention, as particularly illustrated in FIG. 2, conductive material in the form of particles 3 is embedded in some of the layers of the card clothing.

The conductive material is preferably additionally embedded in the intermediate binding agent layers which connect the coating material layers with each other. This makes it possible to further improve the discharge of the frictional electricity.

The conductive material preferably is steel.

The conductive material may have the form of particles.

The particles may be fine wires, preferably having a diameter of about 8–10 $\mu$m and a density and distribution which ensures the contact with the hooks which are employed with the clothing.

It has been found to be particularly useful if the fine wires are randomly mixed in the form of wire sections having a length of about 1–10 mm, preferably 5 mm, into the elastomer which forms the cover layer.

Additionally or alternatively to the wires, the particles may also be splinters.

Additionally or alternatively, pulverous conductive material can also be used.

The conductive material can additionally or alternatively also be used in the form of a fine-mesh fabric which is embedded in the elastomer forming the cover layer and/or in at least one of the intermediate binding agent layers which connect the cover material layers to each other.

While specific embodiments of the invention have been described in detail to illustrate the inventive principles, it will be understood that the invention may be embodied otherwise without departing from such principles.

I claim:

1. A card clothing for cards and carding machines comprising a coating material unit including a plurality of coating material layers of cotton and an elastomer cover layer on an outer side of the card clothing, intermediate binding agent layers connecting the coating material layers to each other and to the elastomer cover layer, the coating material layers containing a plurality of hooks having tips, the hooks extending transversely of the coating material layers and protruding with their tips, wherein, for reducing harmful influences on the carding process resulting from electrostatic charges of the coating material unit due to accumulations of fibers and dust in the coating material unit, the coating material layers contain inhibitors for at least reducing the electrostatic charges, further comprising an electrically conductive material for discharging frictional electricity embedded in at least the cover layer.

2. The card clothing according to claim 1, wherein the hooks are double hooks.

3. The card clothing according to claim 1, wherein the conductive material is additionally embedded in the intermediate binding agent layers.

4. The card clothing according to claim 1, wherein the conductive material is steel.

5. The card clothing according to claim 1, wherein the conductive material is comprised of particles.

6. The card clothing according to claim 5, wherein the particles are fine wires and are contained in at least the cover layer in a density and distribution which ensures contact with the hooks.

7. The card clothing according to claim 6, wherein the fine wires have a diameter of about 8 to 10 $\mu$m.

8. The card clothing according to claim 6, wherein the fine wires are randomly embedded in the form of wire sections having a length of about 1 to 10 mm into the elastomer of the elastomer cover layer.

9. The card clothing according to claim 8, wherein the wire sections have a length of about 5 mm.

10. The card clothing according to claim 5, wherein the particles are splinters.

11. The card clothing according to claim 1, wherein the conductive material is pulverous.

12. The card clothing according to claim 1, wherein the conductive material is a fine-mesh fabric embedded in at least one of the elastomer of the elastomer cover layer and an intermediate binding agent layer.

* * * * *